United States Patent [19]

Grefkes et al.

[11] Patent Number: 4,780,275

[45] Date of Patent: Oct. 25, 1988

[54] CORROSION-RESISTANT COPPER ALLOY AND ARTICLE CONTAINING THE SAME

[75] Inventors: Horst Grefkes, Viersen; Alex Troost, Aachen, both of Fed. Rep. of Germany; Okan Akin, Hoensbroek, Netherlands; Michael Prym, Roetgen-Rott, Fed. Rep. of Germany

[73] Assignee: William Prym-Werke GmbH. & Co. KG., Stolberg, Fed. Rep. of Germany

[21] Appl. No.: 22,908

[22] Filed: Mar. 6, 1987

[51] Int. Cl.[4] ..... C22C 9/06

[52] U.S. Cl. ..... 420/485; 420/487; 420/488; 420/489

[58] Field of Search ..... 420/485, 487, 488, 489, 420/492, 495, 496

[56] References Cited

U.S. PATENT DOCUMENTS 3,103,741 9/1963 Stoeckert ..... 420/489

FOREIGN PATENT DOCUMENTS 3530274 3/1986 Fed. Rep. of Germany ..... 420/487

*Primary Examiner*—L. Dewayne Rutledge
*Assistant Examiner*—George Wyszomierski
*Attorney, Agent, or Firm*—Peter K. Kontler

[57] ABSTRACT

A corrosion-resistant copper-based alloy contains 0.1–5 percent by weight of nickel; 0.01–1.5 percent by weight total of titanium and niobium; 0.2–5 percent by weight total of iron and chromium; 0.01–0.25 percent by weight total of germanium and gallium; and up to 0.01 percent by weight each of the trace elements phosphorus, silicon and manganese. The alloying elements passivate and cathodically protect the copper while the trace elements function as stabilizers. The alloy may be used for the facades of buildings, for roofs, for the gutters of buildings and for applications involving flowing corrosive media.

15 Claims, No Drawings

CORROSION-RESISTANT COPPER ALLOY AND ARTICLE CONTAINING THE SAME

BACKGROUND OF THE INVENTION

The invention relates generally to a copper-based alloy and an article containing the same.

More particularly, the invention relates to a corrosion-resistant copper-based alloy and an article including such alloy.

Corrosion-resistant copper-based alloys are employed for the facades of buildings, for roofs, for the gutters of buildings and for components subjected to the corrosive effects of flowing media. These alloys are exposed to a variety of corrosive actions. One such action is general surface corrosion. This type of corrosion, which affects virtually all copper-based alloys, depends upon the composition of the alloy and usually decreases with time.

Another type of corrosion known as stress-corrosion cracking can occur in certain copper alloys, especially brasses, exposed to specific environments. Stress-corrosion cracking has been recently observed in copper water pipes.

Normal constituents of the atmosphere can constitute potent corrosive agents. Examples are chloride particles found in coastal air; moisture; and contaminants such as sulfur dioxide, carbon dioxide, hydrogen sulfide, ammonia and amines found in urban and industrial areas.

Corrosion can be classified into the following three categories:

1. Dry corrosion which occurs indoors and in desert climes. Dry corrosion is characterized in that the atmosphere is practically devoid of water vapor. In the absence of airborne contaminants, invisible oxide films form on copper and its alloys at room temperature. These films become visible at elevated temperatures. If the air is moderately contaminated, a visible film forms on copper and its alloys even at room temperature. This is known as tarnishing.

2. Moist corrosion which arises when the amount of water vapor in the atmosphere exceeds a lower threshold value referred to as the critical moisture content. Gaseous or solid contaminants accelerate the corrosion rate and frequently lead to a reduction in the critical moisture content.

3. Wet corrosion which is associated with rain and is of great significance in our climate. Generally speaking, the aggressiveness of rain increases as the amount of precipitation decreases. However, rain can also have a beneficial influence on the weather-resistance of copper and its alloys. Thus, rain accelerates the formation of protective films and, in addition, washes away dust, soot and acidic compounds all of which can increase the corrosive rate or affect the surface appearance of copper and copper-based alloys.

If copper is exposed to an atmosphere containing traces of hydrogen sulfide, corrosion proceeds rapidly. The surface film which forms consists of a mixture of copper sulfide and copper oxide with the latter predominating. The film thickness increases parabolically as is the case for the oxidation of copper in clean, dry air. However, the reaction rate is far greater in the presence of sulfides.

The tarnishing rate is proportional to the sulfide content of the atmosphere. At very low sulfide concentrations, the presence of water vapor can inhibit the reaction. In this corrosive process, hydrogen sulfide is clearly the catalyst while the thickness of the tarnish film is the controlling or limiting factor.

As another example, consider the behavior of copper which is exposed to air containing water vapor and contaminated with sulfur dioxide.

In the complete absence of water vapor, sulfur dioxide has no influence on the oxidation of copper at room temperature and such oxidation proceeds as it would in dry, clean air. The metal is not noticeably attacked. However, in the presence of water vapor, the rate of attack depends upon the concentration of sulfur dioxide as well as the relative humidity. Curves of weight gain versus time exhibit a steep slope for the first few days and then level off towards the time axis so that they are almost parallel to such axis after about 30 days. The corrosion rate has a minimum at a sulfur dioxide concentration of approximately 1 percent. This is attributed to the composition of the corrosion products. At a concentration of 1 percent, the film on the copper consists of copper sulfate. Below this concentration, the film consists of basic copper sulfate whereas it consists of an acidic salt above this concentration.

Another striking fact is that the corrosion rate increases significantly at a relative humidity in excess of 63 percent. This phenomenon is ascribed to the hygroscopic characteristics of the film formed by the corrosion products. At a relative humidity above 63 percent, the film becomes capable of absorbing water vapor. The relative humidity threshold value above which the corrosion rate discontinuously jumps to a much higher value is known as the critical moisture content. Here, the amount of water vapor in the air is the controlling or limiting factor and the sulfur dioxide is the catalyst.

The precise mechanism by which the sulfur dioxide attacks the metallic surface is not clear in every case.

Wind, sun and temperature can play a significant role in atmospheric corrosion since they determine how rapidly the surface dries and how long it remains wet. However, a corrosive atmosphere is not adequately characterized by average values of temperature and moisture. The changes in these factors during the time that the material is exposed to the atmosphere are far more suitable for this purpose.

In general, air in industrial areas is considered to be more aggressive than ocean air although this depends upon the degree of contamination of the industrial air and the salt content of the ocean air.

As a rule, copper facades for buildings and copper roofing consist of phosphorus-deoxidized copper. This "pure" copper undergoes patina formation under atmospheric conditions. Patina is a natural protective film which shields the pure copper from the direct effects of weather.

A newly laid copper roof has a more or less marbled appearance. Its surface has dark spots which are generated when the tiles are gripped. After 6 to 12 months, the surface normally assumes a uniform dark brown color. The surface then generally maintains this appearance for several years. In the course of time, a green color may also develop.

The chemical composition of the patina depends upon the climate. In rural and normal urban atmospheres, the patina consists of basic copper sulfate with small amounts of a basic carbonate. At the ocean, the basic sulfate is partially replaced by a basic chloride. The latter can predominate in coastal regions which are remote from urban areas. Depending upon age, the basicity of the film reaches a maximum pH of 3. The corrosion products then consist of $CuSO_4.3Cu(OH)_2$ which is known as brochantite, $CuCO_3.3Cu(OH)_2$ which is known as malachite, and $CuCl_2\ 3Cu(OH)_2$ which is known as atacamite. The protective characteristics of the patina are due to the stability of these compounds.

The degree of contamination, existing winds and rain, as well as the shapes of the copper-containing structural elements and roof inclination, can all influence patina formation.

As a rule, a dense patina develops rapidly in highly contaminated industrial atmospheres. In moderately contaminated urban environments, the copper likewise becomes covered with a dense dark oxide film midway through its life.

The following erosion rates for copper due to atmospheric corrosion are given by W. Wiederhold for Mid and Western Europe (W. Wiederhold, "Die atmosphärische Korrosion von Kupfer und Kupferlegierungen", Zeitschrift Werkstoffe und Korrosion, 15(1964), pp. 633–644):

| | |
|---|---|
| Rural Air | 1.9 micrometers per year |
| Urban Air | 1.5 to 2.9 micrometers per year |
| Industrial Air | 3.2 to 4.0 micrometers per year |
| Ocean Air | 3.8 micrometers per year |

The erosion rates generally apply to the first few years. They decrease continuously with time and reach a value of virtually zero after approximately 70 years at which time the patina has achieved its greatest basicity.

The increasing environmental pollution by contaminants of all types has resulted in the approximate air pollution levels set forth in the appended Table 1 (excerpted from Technischer Überwachungsverein Rheinland, 1983). The units "t/a.km²" in Table 1 represent tons per annum per square kilometer. The footnotes to Table 1 are as follows:

(1)
- A designates the southern Rheinschiene region
- B designates the western Ruhr region
- C designates the eastern Ruhr region
- D designates the central Ruhr region
- E designates Ludwigshafen/Frankenthal
- F designates Rhein-Main
- G designates Mainz (2) Given as $NO_2$ (3) Hydrocarbons and other organic compounds It is noted that the organic gases and vapors for traffic in the southern Rheinschiene region were calculated on the basis of emission factors obtained from infrared measurements.

TABLE I

Comparison of Emissions in the Air for Different Regions

| | Emissions | Region (1) A % | A t/a · km² | B % | B t/a · km² | C % | C t/a · km² | D % | D t/a · km² | E % | E t/a · km² | F % | F t/a · km² | G % | G t/a · km² |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Industry | | | | | | | | | | | | | | | |
| 1 | Carbon Monoxide | 26 | 106 | 85.2 | 1940 | 49.9 | 358 | 28 | 183.4 | 50 | 287.7 | 0.5 | 1.5 | 1.4 | 2.1 |
| 2 | Nitrogen Oxides (2) | 84.2 | 117 | 82.5 | 106 | 84.9 | 114 | 87.0 | 179.1 | 87 | 202.3 | 50.5 | 19.9 | 80.5 | 43.6 |
| 3 | Sulfur Dioxide | 88.1 | 228 | 91.9 | 271 | 88.9 | 157 | 93.9 | 383 | 95.5 | 283 | 66.9 | 36.1 | 85.8 | 70.4 |
| 4 | Organic Gases and Vapors (3) | 88.4 | 129.6 | 87.5 | 211.9 | 22.5 | 6.1 | 56 | 38.4 | 80 | 107.9 | 75.5 | 57.7 | 58.3 | 11.4 |
| Traffic | | | | | | | | | | | | | | | |
| 1 | Carbon Monoxide | 42 | 166 | 5.9 | 143 | 22 | 157 | 28.5 | 186 | 34 | 198.6 | 65 | 185 | 61.9 | 96 |
| 2 | Nitrogen Oxides (2) | 10.8 | 15.2 | 13.9 | 13.9 | 12.3 | 16.6 | 10.6 | 21.8 | 11 | 25.2 | 34.8 | 18.6 | 13.2 | 4.7 |
| 3 | Sulfur Dioxide | 0.9 | 2.1 | 0.9 | 1.8 | 1 | 1.8 | 0.4 | 1.7 | 0.5 | 1.3 | 2.7 | 1.9 | 1.1 | 0.9 |
| 4 | Organic Gases and Vapors (3) | 5 | 7.3 | 5.3 | 12.7 | 52.4 | 14.3 | 26.1 | 17.9 | 14 | 18.4 | 16.5 | 12.6 | 18.2 | 3.6 |
| Home Heating Fuel Small Businesses | | | | | | | | | | | | | | | |
| 1 | Carbon Monoxide | 32 | 130 | 8.9 | 200 | 28.1 | 200 | 43.5 | 285.1 | 16 | 94.5 | 34.5 | 97 | 36.7 | 57 |
| 2 | Nitrogen Oxides (2) | 5 | 6.9 | 3.6 | 4.6 | 2.8 | 3.7 | 2.4 | 5 | 2 | 6 | 14.7 | 5.7 | 6.3 | 3.4 |
| 3 | Sulfur Dioxide | 11 | 28 | 7.2 | 21 | 10.1 | 18 | 5.7 | 23.1 | 4 | 11.9 | 30.4 | 16 | 13.1 | 11 |
| 4 | Organic Gases and Vapors (3) | 6.6 | 9.7 | 7.2 | 17.4 | 25.1 | 6.8 | 17.9 | 12.2 | 6 | 8.3 | 8 | 6.1 | 23.5 | 4.6 |

For the past several years, air pollution has been associated with "acid rain" which has the approximate composition set forth in Table 2 below (excerpted from "Der Rat von Sachverständingen für Umweltfragen: Waldschäden und Luftverunreinigung", Sondergutachten, 1983, Verlag Kohlhammer, Stuttgart-/Mainz).

TABLE 2

Concentration of Pollutant Ions in Rain Water for Different Amounts of Precipitation

| Amount of Precipitation (mm) | $NH_4^+$ (g/m³) | $NO_3^-$ (g/m³) | $SO_4^{--}$ (g/m³) | $Cl^-$ (g/m³) |
|---|---|---|---|---|
| 0.3 | 13.1 | 9.3 | 58.4 | 17.5 |
| 0.3–1.0 | 5.0 | 5.8 | 30.0 | 7.1 |
| 1.1–3.0 | 2.6 | 2.6 | 19.8 | 3.4 |
| 3.1–7.0 | 1.9 | 2.0 | 9.4 | 1.7 |

TABLE 2-continued

| Concentration of Pollutant Ions in Rain Water for Different Amounts of Precipitation | | | | |
|---|---|---|---|---|
| Amount of Precipitation (mm) | $NH_4^+$ (g/m$^3$) | $NO_3^-$ (g/m$^3$) | $SO_4^{--}$ (g/m$^3$) | $Cl^-$ (g/m$^3$) |
| 7.1–11.0 | 1.6 | 1.7 | 7.0 | 1.4 |
| 11.0 | 1.9 | 1.2 | 5.8 | 1.3 |

At high pollutant concentrations, atmospheric and roof water develop an acidity, e.g., by the formation of a "dilute acid" consisting of HCl and $H_2SO_4$, which exceeds the tendency of the copper to form soluble compounds. Thus, the initially thin patina which forms on newly laid roofs is locally destroyed since the substances constituting the patina, e.g., $CuSO_4$ and $CuCO_3$, are no longer stable under the influence of the dilute acid. The copper is accordingly unprotected at these localized areas and is exposed to the permanently acting pollutants. The destructive corrosion proceeds locally and leads to pitting.

OBJECTS AND SUMMARY OF THE INVENTION

It is an object of the invention to provide a copper alloy having improved corrosion resistance.

Another object of the invention is to provide a copper alloy having relatively long-lasting resistance to corrosive media.

An additional object of the invention is to provide a copper alloy which is capable of resisting the action of corrosive media for relatively long periods of time without undergoing significant changes in surface structure.

A further object of the invention is to provide a copper alloy which can withstand the action of corrosive media for relatively long intervals without undergoing substantial changes in color.

Still another object of the invention is to provide an improved corrosion-resistant copper alloy which is relatively inexpensive.

It is also an object of the invention to provide an improved corrosion-resistant copper alloy having hot and cold forming characteristics similar to those of conventional phosphorus-deoxidized copper.

An additional object of the invention is to provide an improved corrosion-resistant copper alloy which is not hardenable.

Yet another object of the invention is to provide a copper alloy having improved resistance to stress-corrosion cracking.

A further object of the invention is to provide a method of making a copper-containing article having improved corrosion resistance.

An additional object of the invention is to provide a copper-containing article having relatively long-lasting resistance to corrosive media.

Another object of the invention is to provide a copper-containing article which is able to resist the action of corrosive media for relatively long periods of time without undergoing significant changes in surface structure.

A further object of the invention is to provide a copper-containing article which can withstand the action of corrosive media for relatively long intervals without undergoing substantial changes in color.

It is additionally an object of the invention to provide an improved corrosion-resistant copper-containing article which may be produced relatively inexpensively.

Yet another object of the invention is to provide a copper-containing article having improved resistance to stress-corrosion cracking.

The preceding objects, as well as others which will become apparent as the description proceeds, are achieved by the invention.

One aspect of the invention resides in a corrosion-resistant copper-based alloy. The alloy comprises nickel in an effective first amount, titanium and/or niobium in an effective total second amount, iron and/or chromium in an effective total third amount, and germanium and/or gallium in an effective total fourth amount.

Another aspect of the invention resides in a structure comprising an article of manufacture which includes a corrosion-resistant copper-based alloy containing nickel in an effective first amount, titanium and/or niobium in an effective total second amount, iron and/or chromium in an effective total third amount, and germanium and/or gallium in an effective total fourth amount.

The structure may have a facade and the article may then constitute part of such facade. Similarly, the structure may have a roof and the article may constitute part of the roof. Furthermore, the structure may have a gutter and the article may here constitute part of the gutter. The structure may also have a section which is exposed to a corrosive medium, particularly a flowing corrosive medium, and the article may constitute part of this section.

The alloy preferably contains both titanium and niobium, both iron and chromium, and both germanium and gallium.

The alloy may further comprise at least one trace element selected from the group consisting of metalloids and metals. Each such trace element is advantageously present in an amount of at most 0.01 percent by weight. The balance of the alloy may be copper.

The amount of nickel is preferably in the range of 0.1 to 5 percent by weight; the total amount of titanium and niobium is preferably in the range of 0.01 to 1.5 percent by weight; the total amount of iron and chromium is preferably in the range of 0.2 to 5 percent by weight; and the total amount of germanium and gallium is preferably in the range of 0.01 to 0.25 percent by weight.

The novel features which are considered as characteristic of the invention are set forth in particular in the appended claims. The improved alloy and article, however, will be best understood upon perusal of the following detailed description of certain specific embodiments.

DESCRIPTION OF THE PREFERRED EMBODIMENTS

There are basically three mechanisms for increasing the resistance of copper to corrosion. These are as follows:

1. Ennobling the copper by raising its position in the electromotive series, e.g., by alloying the copper with gold or silver.
2. Increasing the passivity of the copper, e.g., by means of titanium.
3. Cathodically protecting the copper, e.g., by means of a sacrificial element such as iron.

Since ennoblement is not economically feasible, the invention provides for alloying copper with elements which passivate and cathodically protect the copper. In accordance with the invention, the alloying elements are selected in such a manner that both passivation and cathodic protection of the copper are achieved. Moreover, the alloying elements are selected with a view to increasing the solubility ranges.

Table 3 shows the composition of a copper alloy according to the invention.

TABLE 3

| Element(s) | Percent by Weight |
|---|---|
| Nickel | 0.1–5 |
| Titanium and/or Niobium | 0.01–1.5 total |
| Iron and/or Chromium | 0.2–5 total |
| Germanium and/or Gallium | 0.01–0.25 total |
| Trace Elements | at most 0.01 each |
| Copper | balance |

It is preferred to use both titanium and niobium, both iron and chromium, and both germanium and gallium.

The trace elements are preferably metalloids and/or metals, and both metalloids and metals may be employed simultaneously. Examples of suitable trace metalloids which may be added to the copper are phosphorus and silicon. An appropriate trace metal which may be incorporated in the copper is manganese. The trace elements function as stabilizers.

These components serve several purposes as follows:

A. They stabilize the phase boundaries.

B. They inhibit segregation.

C. They affect the diffusion coefficients.

The alloy in accordance with the invention will be seen to contain multiple alloying elements as well as trace elements.

A particularly advantageous composition for the alloy according to the invention is set forth in Table 4.

TABLE 4

| Element(s) | | Percent by Weight |
|---|---|---|
| Nickel | | 0.1–2 |
| Titanium and Niobium | | 0.01–0.25 total |
| Iron and Chromium | | 0.2–2 total |
| Germanium and Gallium | | 0.01–0.25 total |
| Trace Elements | | 0.01 total |
| (Metalloids: | Phosphorus and Silicon | |
| Metal: | Manganese) | |
| Copper | | balance |

The corrosion-resistant copper-based alloy in accordance with the invention has been found to be well-suited for the facades of buildings, for roofs, for the gutters of buildings, etc. This alloy has further been found to be well-adapted for other applications such as those where copper is subjected to corrosive action by a flowing medium, i.e., a flowing gas, liquid or vapor. Examples of the latter applications are piping systems, hot water devices, cylinders, boilers, sea water desalinization plants, coolers, heat exchangers, brake lines, lines in hydraulic systems, and so on. In these applications, the corrosive action often takes place on the outside as well as the inside. For instance, automotive cooling systems and brake lines are subjected to corrosion on the outside by rain or salt water.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A corrosion-resistant alloy, consisting essentially of nickle in an amount of at least 0.1 percent by weight, titanium and/or niobium in an amount of at least 0.01 percent by weight, iron and/or chromium in an amount of at least 0.2 percent by weight, germanium and/or gallium in an amount of about 0.01 to 0.25 percent by weight, and the balance copper.

2. The alloy of claim 1, further comprising at least one trace element selected from the group consisting of metalloids and metals.

3. The alloy of claim 2, wherein the amount of each element of said group consisting of metalloids and metals is at most 0.01 percent by weight.

4. The alloy of claim 2, wherein said at least one trace element is phosphorus.

5. The alloy of claim 2, wherein said at least one trace element is silicon.

6. The alloy of claim 2, wherein said at least one trace element is manganese.

7. The alloy of claim 1, wherein the amount of nickel is at most 5 percent by weight, the amount of titanium and/or niobium is at most 1.5 percent by weight, and the amount of iron and/or chromium is at most 5 percent by weight.

8. The alloy of claim 7, comprising at most 0.01 percent by weight each of trace elements selected from the group consisting of metalloids and metals.

9. The alloy of claim 1, wherein said the amount of nickel is at most 0.2 percent by weight.

10. The alloy of claim 1, wherein the amount of titanium and/or niobium is at most 2 0.25 percent by weight.

11. The alloy of claim 1, wherein the amount of iron and/or chromium is at most percent by weight.

12. A facade constructed of an alloy according to claim 1.

13. A roof constructed of an alloy according to claim 1.

14. A gutter constructed of an alloy according to claim 1.

15. A structure having a section exposed to a corrosive medium and constructed of an alloy according to claim 1.

* * * * *